US010666022B2

(12) United States Patent
Shibata

(10) Patent No.: US 10,666,022 B2
(45) Date of Patent: May 26, 2020

(54) IGNITION PLUG AND METHOD FOR MANUFACTURING IGNITION PLUG

(71) Applicant: DENSO CORPORATION, Kariya, Aichi-pref. (JP)

(72) Inventor: Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/453,016

(22) Filed: Jun. 26, 2019

(65) Prior Publication Data

US 2019/0319433 A1 Oct. 17, 2019

Related U.S. Application Data

(63) Continuation of application No. PCT/JP2017/044369, filed on Dec. 11, 2017.

(30) Foreign Application Priority Data

Dec. 27, 2016 (JP) ..... 2016-253130
Sep. 25, 2017 (JP) ..... 2017-183792

(51) Int. Cl.
*H01T 13/32* (2006.01)
*H01T 21/02* (2006.01)

(52) U.S. Cl.
CPC ..... *H01T 13/32* (2013.01); *H01T 21/02* (2013.01)

(58) Field of Classification Search
USPC ..... 123/169 EL
See application file for complete search history.

(56) References Cited

U.S. PATENT DOCUMENTS

2002/0067111 A1 6/2002 Shibata et al.
2005/0023949 A1* 2/2005 Hori ..... H01T 13/39 313/141
2005/0264151 A1 12/2005 Mori et al.
2006/0163992 A1* 7/2006 Kanao ..... H01T 13/39 313/141
2013/0099652 A1 4/2013 Below et al.
2019/0237942 A1* 8/2019 Hattori ..... H01T 13/20

FOREIGN PATENT DOCUMENTS

EP 1 139 529 A2 10/2001

* cited by examiner

*Primary Examiner* — Ashok Patel
(74) *Attorney, Agent, or Firm* — Nixon & Vanderhye PC

(57) ABSTRACT

An ignition plug includes a main metal fitting; an earth electrode having one end fixed to the main metal fitting and including, in a part of the other end, an inclined portion inclined toward the center axis line of the main metal fitting; an earth electrode-side chip joined to the inclined portion; and a center electrode having one end exposed from the main metal fitting. The ignition plug includes: a pedestal which has an elliptic cylindrical shape, is disposed so as to have a minor axis directed toward the earth electrode-side chip, and has an end surface forming an inclined surface inclined along the minor axis with respect to the center axis line; and a center electrode-side chip laser-welded to the inclined surface. The earth electrode-side chip and the center electrode-side chip face each other.

11 Claims, 8 Drawing Sheets

IGNITION PLUG AND METHOD FOR MANUFACTURING IGNITION PLUG

CROSS-REFERENCE TO RELATED APPLICATION

The present application is a continuation application of International Application No. PCT/JP/2017/044369, filed Dec. 11, 2017, which claims priority to Japanese Patent Applications No. 2016-253130 filed Dec. 27, 2016 and No. 2017-183792 filed Sep. 25, 2017. The entire contents of each of which are hereby incorporated by reference.

BACKGROUND

Technical Field

The present disclosure relates to an ignition plug.

Related Art

Internal combustion engines such as gasoline engines are equipped with ignition plugs, each of which is configured to be able to ignite an air-fuel mixture in a combustion chamber of the internal combustion engine by causing an electric spark between a center electrode and an earth electrode, which are included in the ignition plug and facing each other.

SUMMARY

As an aspect of the present disclosure, an ignition plug mounted in an internal combustion engine is provided. The ignition plug includes: a main metal fitting having a tubular shape; an earth electrode having one end fixed to the main metal fitting and including, in a part of the other end, an inclined portion inclined toward a center axis line of the main metal fitting; an earth electrode-side chip joined to the inclined portion of the earth electrode; a center electrode housed in the main metal fitting and having one end exposed and extending from the main metal fitting; a pedestal having an elliptic cylindrical shape and disposed so as to have a minor axis directed toward the earth electrode-side chip, the pedestal being formed on an end portion of the center electrode exposed from the main metal fitting and having an end surface forming an inclined surface inclined along the minor axis with respect to the center axis line; and a center electrode-side chip having a circular cylindrical shape and laser-welded to the inclined surface of the pedestal. The earth electrode-side chip and the center electrode-side chip have end surfaces facing each other.

DETAILED DESCRIPTION OF THE PREFERRED EMBODIMENTS

Figure 1:
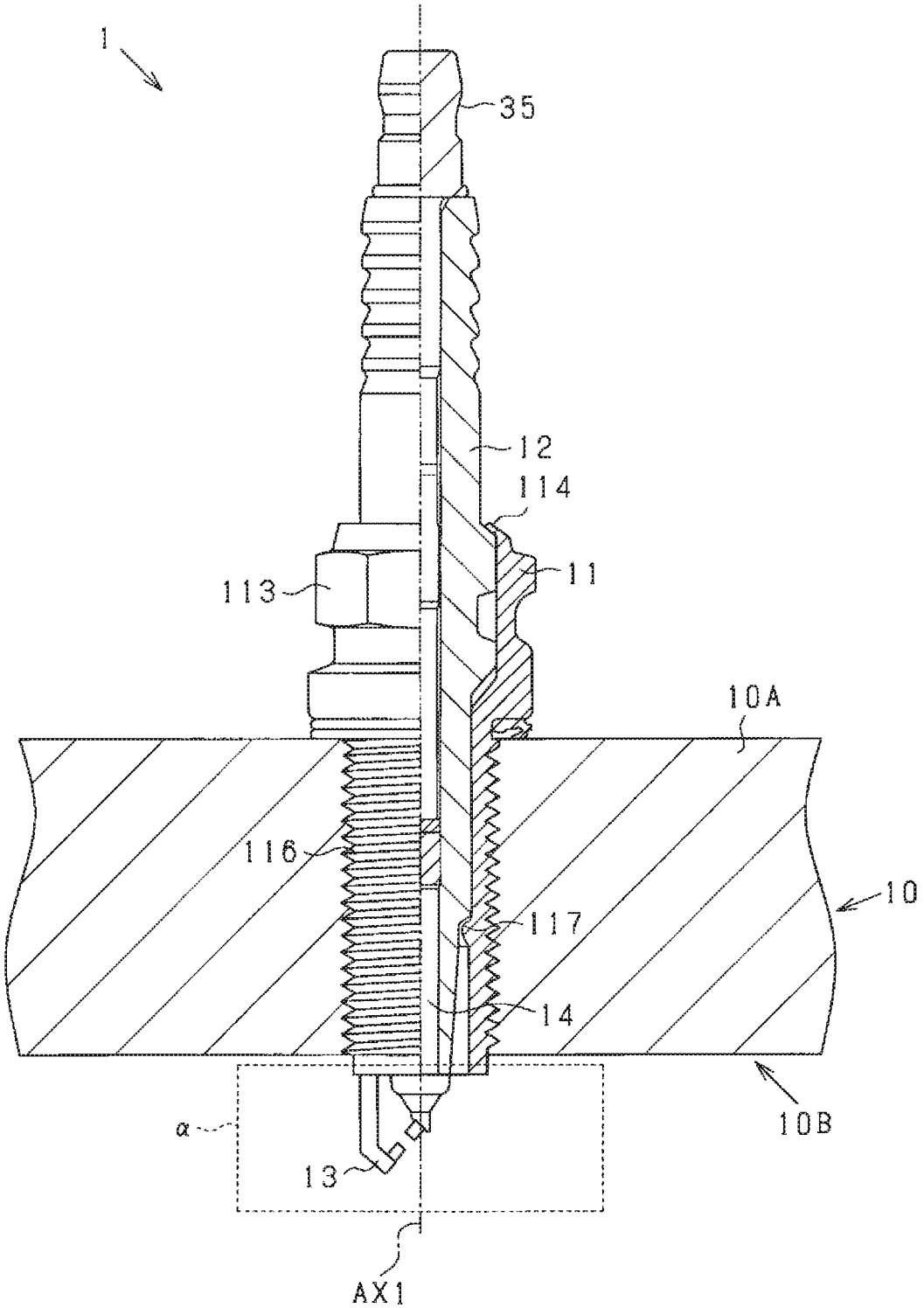
FIG. 1 is a half cross-sectional view of an ignition plug according to an embodiment.

Internal combustion engines such as gasoline engines are equipped with ignition plugs, each of which is configured to be able to ignite an air-fuel mixture in a combustion chamber of the internal combustion engine by causing an electric spark between a center electrode and an earth electrode, which are included in the ignition plug and facing each other. Examples of such ignition plugs include the ignition plug disclosed in JP 2005-339981 A. In this ignition plug, the center line of the center electrode is in a position offset from the center line of the ignition plug and is parallel to the center line of the ignition plug. Furthermore, the center axis line of a center electrode-side chip attached to the tip of the center electrode is slightly tilted with respect to the center line of the center electrode, and the center axis line of an earth electrode-side chip attached to the inside of the tip of the earth electrode (corresponding to the side electrode) is slightly tilted with respect to the center line of the ignition plug. The center electrode-side chip and the earth electrode-side chip face each other across the center line of the ignition plug and have center axis lines that coincide with each other.

In the ignition plug disclosed in JP 2005-339981 A, a center electrode tip portion includes a tapered portion that protrudes from an insulator tip surface having an annular shape, as a circular cylindrical extension having a predetermined amount, and is gradually reduced in diameter. The circular cylindrical center electrode-side chip is attached to the tip of the tapered portion which is at the end having a reduced diameter. In this case, the tapered portion formed at the center electrode tip portion is in the shape of an approximate truncated cone. Since the center electrode tip portion of a commonly available ignition plug has a circular cylindrical shape, the center electrode including, at the tip portion, the tapered portion having the shape of an approximate truncated cone is far from having a common shape. Therefore, there is the concern that the manufacturing cost of the center electrode including, at the tip portion, the tapered portion having the shape of an approximate truncated cone may be higher than the manufacturing cost of a circular cylindrical center electrode. Thus, in order to curb the rise of the manufacturing cost of a center electrode, it is desirable that the tip portion of the center electrode have a circular cylindrical shape. In the case where the tip portion of the center electrode has a circular cylindrical shape, however, attaching the center electrode-side chip to the tip portion does not cause the center electrode-side chip and the earth electrode-side chip tilted with respect to the center line of the ignition plug to face each other.

As a measure against this issue, a pedestal formed by partially machining a circular cylindrical portion may be provided between the center electrode and the center electrode-side chip. Specifically, the pedestal is formed on an end portion of the center electrode that is exposed from a main metal fitting. An end surface of the pedestal may include an inclined surface inclined to face an end surface of the earth electrode-side chip, and the center electrode-side chip may be attached to the inclined surface.

In this case, when the pedestal is circular cylindrical, the inclined surface of the pedestal is expected to be elliptical. If the circular cylindrical center electrode-side chip is laser-welded to the elliptical inclined surface, the molten state of a molten portion between the center electrode-side chip and the pedestal is different between the major diameter side and the minor diameter side of the elliptical inclined surface. Specifically, the molten portion at the major diameter side of the elliptical inclined surface contains a larger amount of metal included in the pedestal than that in the molten portion at the minor diameter side of the elliptical inclined surface. In this case, the molten portion may have different coefficients of thermal expansion at the major diameter side and the minor diameter side of the elliptical inclined surface. In other words, the magnitude of internal force (thermal stress) generated as a result of a change in temperature of the molten portion which joins the center electrode-side chip and the inclined surface of the pedestal together is different between the molten portion at the major diameter side of the elliptical inclined surface and the molten portion at the minor diameter side of the elliptical inclined surface; this may be put in another way: the thermal stress generated as a result of a change in temperature of the molten portion which joins the center electrode-side chip and the inclined surface of the pedestal together is not uniform. For this reason, if an internal combustion engine is equipped with the above-described ignition plug in which the center electrode chip is laser-welded to the end surface of the circular cylindrical pedestal formed on the end portion of the center electrode that is exposed from the main metal fitting, non-uniform thermal stress is generated at the molten portion which joins the center electrode-side chip and the inclined portion of the pedestal together, every time a flammable air-fuel mixture is ignited in the internal combustion engine. Therefore, the joint strength of a part of the molten portion in which particularly high thermal stress is generated is reduced every time the flammable air-fuel mixture is ignited in the internal combustion engine, which may result in separation of the center electrode-side chip from the tapered portion of the center electrode.

The present disclosure has been conceived to solve the aforementioned problem, and has an object to provide an ignition plug in which the center axis line of an earth electrode-side chip and the center axis line of a center electrode-side chip are tilted with respect to the center axis line of a main metal fitting and a pedestal is interposed between the center electrode-side chip and a center electrode and which is capable of preventing the occurrence of the center electrode-side chip being separated from the pedestal due to a change in temperature that occurs as a result of repeated ignition of an air-fuel mixture in an internal combustion engine.

FIG. 1 illustrates a half cross-sectional view of an ignition plug 1 attached to an internal combustion engine 10. The ignition plug 1 includes a main metal fitting 11 made of a metal and having an approximately circular tubular shape.

On the outer peripheral edge of the main metal fitting 11 is provided a tool engagement portion 113 having a hexagonal outer circumference for allowing engagement of a plug wrench which is used to attach the main metal fitting 11 to a wall part of a cylinder head 10A which forms a combustion chamber 10B of the internal combustion engine 10. In a section of the main metal fitting 11 that is on the combustion chamber 10B side (referred to as the tip side) relative to the tool engagement portion 113, a threaded part (male threaded part) 116 for attaching the ignition plug 1 to the wall part of the cylinder head 10A is formed.

An insulator 12 is inserted into the main metal fitting 11. The insulator 12 is supported by a support portion 117 formed on the inner peripheral edge of the main metal fitting 11 and having an inner diameter reduced toward the tip. Furthermore, the insulator 12 is fixed by a crimped portion 114 formed at the end of the tool engagement portion 113 (the tail end of the main metal fitting 11) that is on the opposite side (referred to as the tail end side) from the combustion chamber 10B.

A center electrode 14 having an approximately circular cylindrical shape is held on the inner periphery of the insulator 12. Furthermore, an earth electrode 13 is provided protruding on the tip side of the main metal fitting 11 and is located opposite to the tip side of the center electrode 14 across a predetermined electrical discharge gap.

Figure 2:
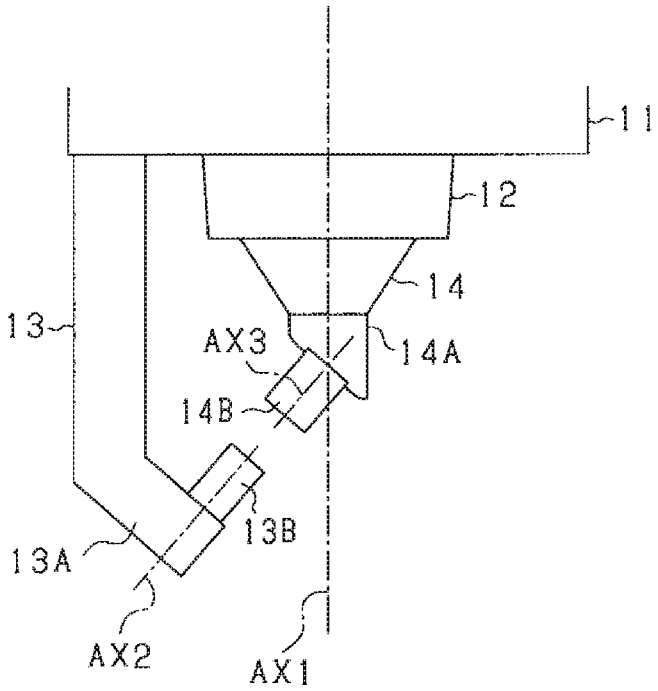
FIG. 2 is an enlarged view of a main area a in FIG. 1.

FIG. 2 illustrates an enlarged cross-sectional view of the main area including the center electrode 14 and the earth electrode 13. The main area refers to the region denoted by $\alpha$ in FIG. 1.

The earth electrode 13 has one end fixed to the main metal fitting 11 and includes, in a part including the other end, an inclined portion 13A inclined toward a center axis line AX1 of the main metal fitting 11 (which may be restated as the center axis line of the center electrode 14). Furthermore, an earth electrode-side chip 13B is joined to the inward surface of the inclined portion 13A (the surface of the inclined portion 13A on the side on which the center electrode 14 is located).

Meanwhile, the center electrode 14 held on the inner periphery of the insulator 12 has a tip portion exposed from the insulator 12 (in other words, the tip portion of the center electrode 14 is exposed from the main metal fitting 11). Furthermore, a pedestal 14A is formed at the tip portion of the center electrode 14 exposed from the insulator 12, and an inclined surface 14C (refer to FIG. 5) inclined toward the center axis line AX1 of the main metal fitting 11 is formed on an end surface of the pedestal 14A. Moreover, a circular cylindrical center electrode-side chip 14B is laser-welded to the inclined surface 14C. The earth electrode-side chip 13B and the center electrode-side chip 14B face each other. In other words, the center axis line AX2 of the earth electrode-side chip 13B and the center axis line AX3 of the center electrode-side chip 14B are tilted with respect to the center axis line AX1 of the main metal fitting 11. Furthermore, in the present embodiment, the center axis line AX2 of the earth electrode-side chip 13B and the center axis line AX3 of the center electrode-side chip 14B are positioned on the same axis line.

Note that the pedestal 14A is made from a Ni alloy and each of the earth electrode-side chip 13B and the center electrode-side chip 14B is made from a noble metal such as an Ir alloy.

Figure 3:
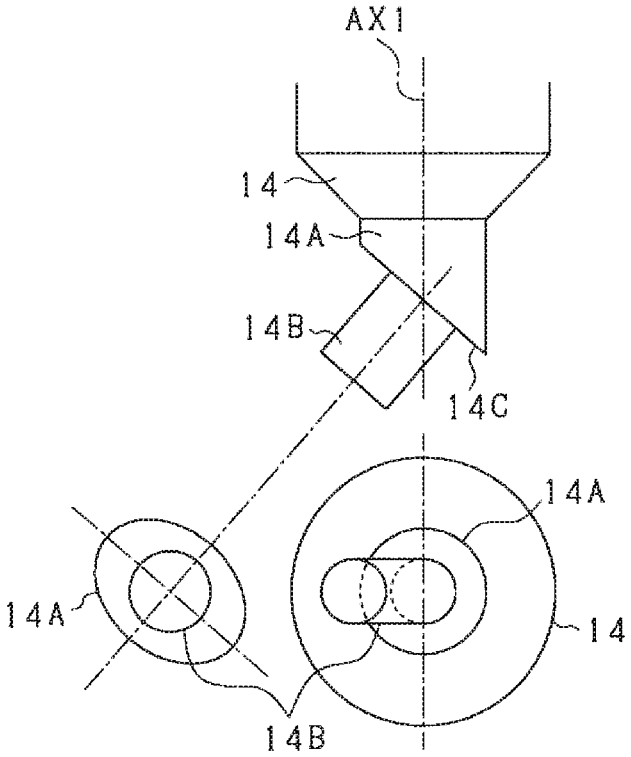
FIG. 3 is a diagram showing, from multiple points of view, a joined state of an inclined surface of a circular cylindrical pedestal and a center electrode-side chip according to a comparative example.
Figure 4:
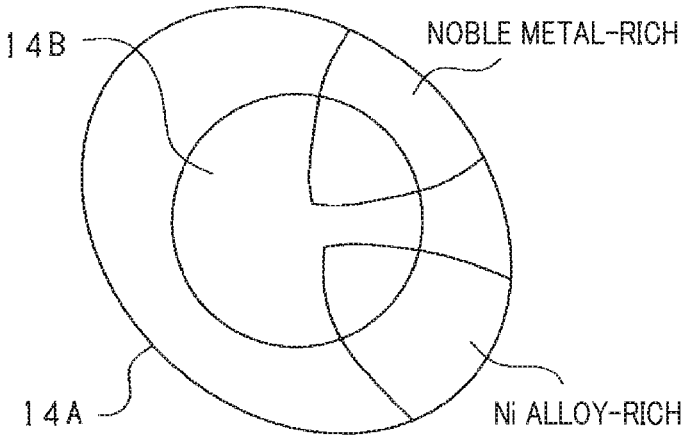
FIG. 4 is a schematic diagram showing a molten state of a molten portion between the inclined surface of the circular cylindrical pedestal and the center electrode-side chip according to the comparative example.

In the above-described ignition plug 1, if the pedestal 14A is circular cylindrical, the inclined surface 14C of the pedestal 14A is expected to be elliptical, as in the comparative example disclosed in FIG. 3. As shown in FIG. 4, when the circular cylindrical center electrode-side chip 14B is laser-welded to the elliptical inclined surface 14C of the pedestal 14A, the area of the elliptical inclined surface 14C outside the molten portion between the center electrode-side chip 14B and the pedestal 14A is different in width, resulting in the molten state of the molten portion being different, between the major diameter side and the minor diameter side of the elliptical inclined surface 14C. Specifically, the molten portion of the elliptical inclined surface 14C at the major diameter side contains a larger amount of Ni alloy included in the pedestal 14A than that in the molten portion of the elliptical inclined surface 14C at the minor diameter side. Conversely, the molten portion of the elliptical inclined surface 14C at the minor diameter side contains a larger amount of noble metal included in the center electrode-side chip 14B than that in the molten portion of the elliptical inclined surface 14C at the major diameter side. Thus, the molten portion may have different coefficients of thermal expansion at the major diameter side and the minor diameter side of the elliptical inclined surface 14C. In other words, the magnitude of thermal stress generated as a result of a change in temperature of the molten portion which joins the center electrode-side chip 14B and the inclined surface 14C of the pedestal 14A together is different between the molten portion at the major diameter side of the elliptical surface and the molten portion at the minor diameter side of the elliptical surface.

For this reason, if an internal combustion engine 10 is equipped with the above-described ignition plug 1 in which the center electrode-side chip 14B is laser-welded to the inclined surface 14C formed on the end surface of the circular cylindrical pedestal 14A on the tip side, non-uniform thermal stress is generated at the molten portion which joins the center electrode-side chip 14B and the inclined surface 14C of the pedestal 14A together, every time a flammable air-fuel mixture is ignited in the internal combustion engine 10. Therefore, the joint strength of a part of the molten portion in which particularly high thermal stress is generated is reduced every time the flammable air-fuel mixture is ignited in the internal combustion engine 10, which may result in separation of the center electrode-side chip 14B from the inclined surface 14C of the pedestal 14A.

Figure 5:
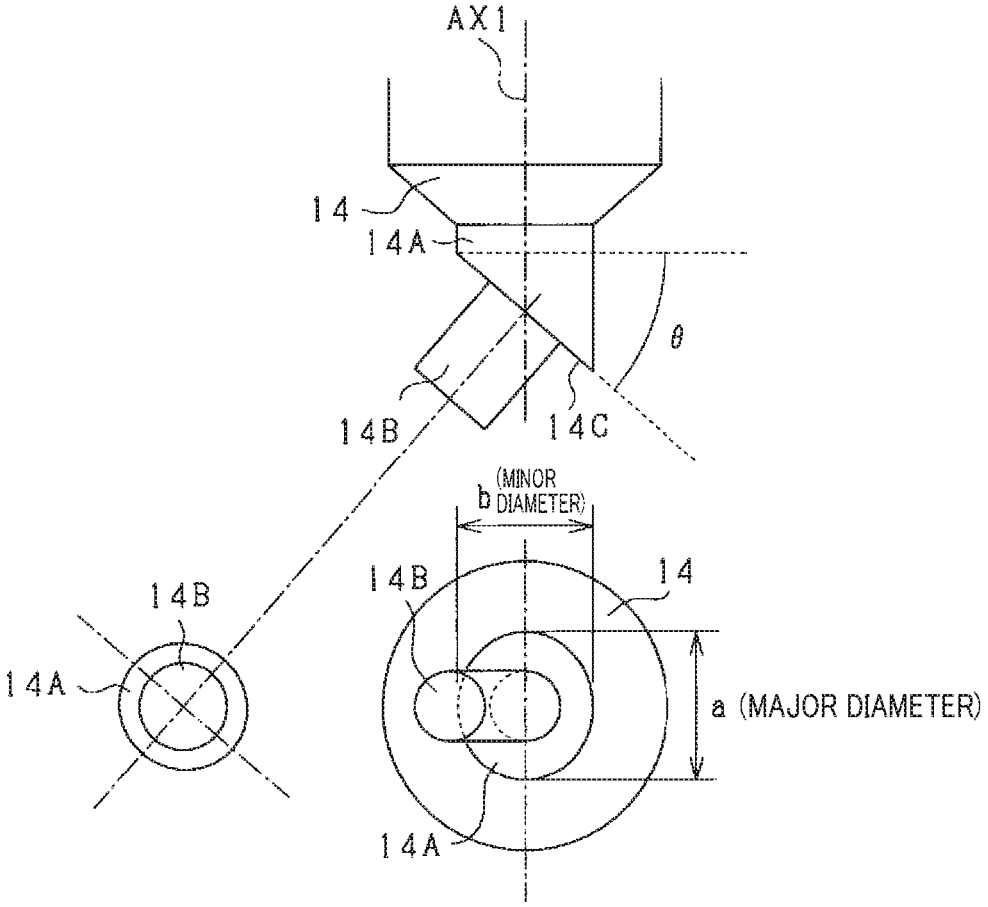
FIG. 5 is a diagram showing, from multiple points of view, a joined state of an inclined surface of an elliptic cylindrical pedestal and a center electrode-side chip according to the embodiment.

As a measure against this issue, in the present embodiment shown in FIG. 5, the pedestal 14A included in the ignition plug 1 has an elliptic cylindrical shape, is disposed to have a minor axis directed toward the earth electrode-side chip 13B, and has, on an end surface on the side on which the center electrode-side chip 14B is laser-welded, the inclined surface 14C inclined along the minor axis with respect to the center axis line AX1 of the main metal fitting 11. As a result, the inclined surface 14C of the pedestal 14A approximates a perfect circle, and thus when the pedestal 14A and the center electrode-side chip 14B are laser-welded, the width of the area outside the molten portion between the pedestal 14A and the center electrode-side chip 14B can be made uniform. Consequently, the molten state of the molten portion between the pedestal 14A and the center electrode-side chip 14B can be made uniform. Thus, in the case where the internal combustion engine 10 is equipped with the ignition plug 1, it is possible to make uniform the thermal stress that is generated in the molten portion which joins the center electrode-side chip 14B and the inclined surface 14C of the pedestal 14A together as a result of the flammable air-fuel mixture ignited in the internal combustion engine 10, and thus separation of the center electrode-side chip 14B from the pedestal 14A can be inhibited. Note that FIGS. 3 and 5 show the state where the center electrode-side chip 14B has not yet been laser-welded to the inclined surface 14C of the pedestal 14A.

There are cases where a rod having a predetermined diameter is inserted between the electrodes of the ignition plug 1, for example, when a vehicle inspection is conducted by a car dealer, to check the distance (gap length) between the electrodes of the ignition plug 1. At this time, the rod may contact the center electrode-side chip 14B, causing a bending moment to occur in the center electrode-side chip 14B, which may result in separation of the center electrode-side chip 14B from the pedestal 14A.

The inventor conducted the following test in order to find a configuration in which, even if a bending moment is generated in the center electrode-side chip 14B as a result of the rod contacting the center electrode-side chip 14B, the center electrode-side chip 14B has flexural strength high enough to withstand the bending moment.

Before a vehicle inspection including the step of checking the distance between the electrodes of the ignition plug 1 is conducted, thermal stress is assumed to have already been generated many times in the molten portion which joins the center electrode-side chip 14B and the inclined surface 14C of the pedestal 14A together because the ignition plug 1 has been frequently exposed to a high-temperature environment as a result of the flammable air-fuel mixture ignited in the internal combustion engine 10. In other words, it is assumed that the step of checking the distance between the electrodes will be conducted on the ignition plug 1 including the molten portion in which thermal stress has already been generated many times. In view of this, before the later-described flexural strength test was conducted, the pedestal 14A with the center electrode-side chip 14B laser-welded thereto was exposed, first, to an environment that is substantially the same as the environment in which the ignition plug 1 is exposed as a result of the flammable air-fuel mixture ignited many times in the internal combustion engine 10. Specifically, a cycle of exposure of the pedestal 14A, which has the inclined surface 14C with the center electrode-side chip 14B laser-welded thereto, in a low-temperature environment (for example, 150° C.) for a predetermined length of time (for example, six minutes) and then the exposure thereof in a high-temperature environment (for example, 950° C.) for a predetermined length of time was repeated a predetermined number of times (for example, 200 cycles).

Figure 6:
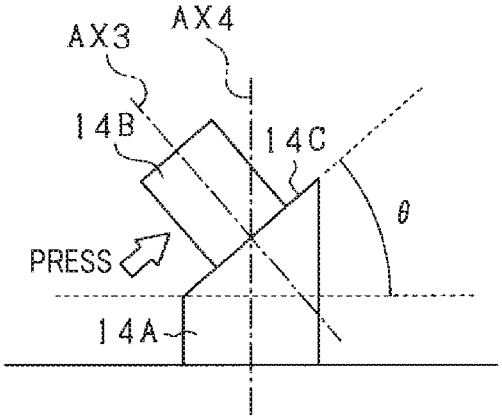
FIG. 6 is a schematic diagram showing the center electrode-side chip during a flexural strength test.
Figure 7:
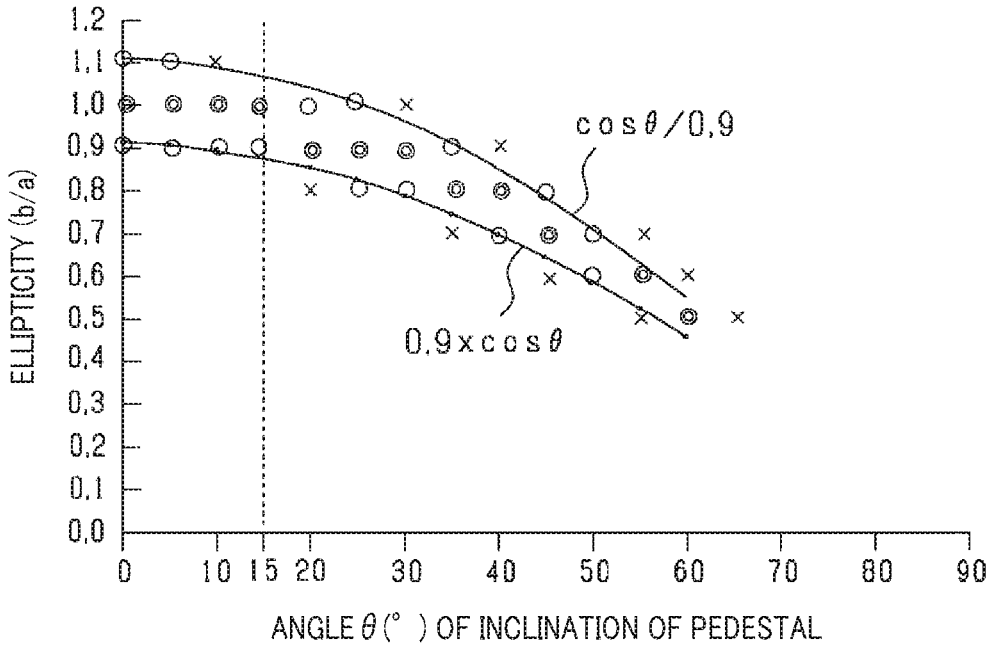
FIG. 7 is a diagram showing the result of the flexural strength test conducted on the center electrode-side chip.

After the above process was performed, as shown in FIG. 6, the center electrode-side chip 14B was pressed in the direction perpendicular to the center axis line AX3 of the center electrode-side chip 14B, and the flexural strength upon separation of the center electrode-side chip 14B was measured. The results are shown in FIG. 7. As shown in the plan view of FIG. 8, the length of the major diameter of the pedestal 14A is referred to as a major diameter a, and the length of the minor diameter of the pedestal 14A is referred to as a minor diameter b.

Figure 8:
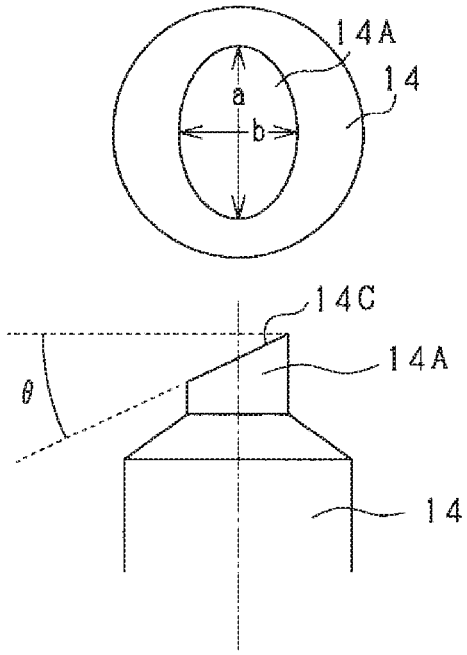
FIG. 8 is a schematic diagram showing major and minor diameters of the pedestal and an angle of inclination of the pedestal.

Suppose that the pedestal 14A has a circular cylindrical shape; then, the major diameter a and the minor diameter b are equal and thus, the value obtained by dividing the minor diameter b by the major diameter a is 1. In contrast, when the pedestal 14A has an elliptic cylindrical shape, the major diameter a and the minor diameter b are different and thus, the value obtained by dividing the minor diameter b by the major diameter a is different from 1. In addition, since the larger the difference between the major diameter a and the minor diameter b, the more different the shape of the pedestal 14A is from a circular cylinder, the calculation of a value obtained by dividing the minor diameter b by the major diameter a shows how much different the elliptic cylindrical shape of the pedestal 14A is from a circular cylinder. Thus, the vertical axis in FIG. 7 represents a value obtained by dividing the minor diameter b by the major diameter a, and this value is referred to as ellipticity. Meanwhile, the horizontal axis in FIG. 7 represents the angle of inclination θ of the pedestal 14A, and as shown in FIG. 8, the angle of inclination θ indicates the angle of inclination of the inclined surface 14C of the pedestal 14A with respect to the plane perpendicular to the center axis line AX4 of the pedestal 14A. Note that, in the present embodiment, the center axis line AX4 of the pedestal 14A is located on the same axial line as the center axis line AX1 of the main metal fitting 11; thus, as shown in FIG. 5, the angle of inclination may be described as the angle of inclination of the inclined surface 14C of the pedestal 14A with respect to the plane perpendicular to the center axis line AX1 of the main metal fitting 11.

In the present test, the maximum force applied to the center electrode-side chip 14B as a result of the rod contacting the center electrode-side chip 14B is expected to be 30 N, and thus the center electrode-side chip 14B that has successfully withstood the force of at least 50 N was determined as having sufficient flexural strength. Therefore, in the graph shown in FIG. 7, the cross represents flexural strength upon separation of the center electrode-side chip 14B of less than 50 N, the circle represents flexural strength upon separation of the center electrode-side chip 14B of at least 50 N but less than 100 N, and the double circle represents flexural strength upon separation of the center electrode-side chip 14B of greater than 100 N.

Here, the flexural strength upon separation of the center electrode-side chip 14B remained high by reducing the ellipticity of the pedestal 14A (setting the shape of the pedestal 14A more different from a cylinder) as the angle θ of inclination of the pedestal 14A increases. Furthermore, it was found that when the angle θ of inclination of the pedestal 14A has a predetermined value, the flexural strength upon separation of the center electrode-side chip 14B was 50 N or more with multiple ellipticity values. Therefore, approximating the minimum and maximum values of the ellipticity with the flexural strength upon separation of the center electrode-side chip 14B of at least 50 N led to Expression (1). In other words, it was found that when the pedestal 14A was formed so as to satisfy the expression (1), the center electrode-side chip 14B laser-welded to the inclined surface 14C was given high flexural strength. More specifically, it was found that when the pedestal 14A was formed so that the value obtained by dividing the minor diameter b by the major diameter a (the ellipticity of the pedestal 14A) is greater than or equal to the value obtained by multiplying the cosine value of the angle θ of inclination by 0.9, but is less than the value obtained by dividing the angle θ of inclination by 0.9, the center electrode-side chip 14B laser-welded to the inclined surface 14C was given high flexural strength.

$$0.9\times\cos\theta \le b/a \le \cos\theta/0.9 \quad (1)$$

Furthermore, it was found from the test result shown in FIG. 7 that in the case where the center electrode-side chip 14B is laser-welded to the circular cylindrical pedestal 14A (ellipticity=1), when the angle θ of inclination of the inclined surface 14C of the pedestal 14A is 15° or less, the center electrode-side chip 14B was given high flexural strength of 100 N or more. In other words, it was found that when the angle θ of inclination of the inclined surface 14C of the circular cylindrical pedestal 14A was greater than 15°, the center electrode-side chip 14B was not given high flexural strength of 100 N or more. Therefore, in the case of setting the angle θ of inclination of the inclined surface 14C of the circular cylindrical pedestal 14A to greater than or equal to 20°, the use of the elliptic cylindrical pedestal 14A allows the center electrode-side chip 14B to have higher flexural strength than that when the circular cylindrical pedestal 14A is used.

On the other hand, if the angle θ of inclination of the inclined surface 14C of the pedestal 14A is set to 55° or more, the tip portion of the pedestal 14A may be broken or damaged because of being unable to withstand the force applied when the center electrode-side chip 14B is pressed to the tip portion of the pedestal 14A during the later-described laser welding step of performing laser-welding in the state where the center electrode-side chip 14B is brought into contact with the inclined surface 14C of the pedestal 14A.

On the basis of the foregoing results, the angle θ of inclination of the inclined surface 14C of the pedestal 14A with respect to the plane perpendicular to the center axis line AX4 of the elliptic cylindrical pedestal 14A is set between 20° and 50°, inclusive. It was found that with this setting, the center electrode-side chip 14B can be given higher flexural strength than that when the circular cylindrical pedestal 14A is used, and breakage or damage to the minor diameter side of the inclined surface 14C during the laser welding step can be inhibited.

Thus, the elliptic cylindrical pedestal 14A according to the present embodiment has an end surface on the tip side forming the inclined surface 14C inclined along the minor axis with respect to the center axis line AX1 of the main metal fitting 11 so that the angle of θ inclination is between 20° and 50°, inclusive, and is formed so as to satisfy the expression (1). The pedestal 14A formed in this manner is disposed so that the minor axis is directed toward the earth electrode-side chip 13B.

The ignition plug 1 can be manufactured by performing the first to fourth steps described below. Note that the major diameter a and the minor diameter b of the pedestal 14A and the angle θ of inclination of the inclined surface 14C of the pedestal 14A are determined before the first step is performed.

In the first step, cold forging is performed in which a predetermined force is applied to a plate member made from a Ni alloy at room temperature using a jig or the like, and thus the elliptic cylindrical pedestal 14A is formed at one end of the approximately circular cylindrical center electrode having the predetermined major diameter a and the predetermined minor diameter b.

In the second step, one end of the pedestal 14A formed in the first step is cut off to form the inclined surface 14C which has the angle θ of inclination and is inclined along the minor axis with respect to the center axis line AX1 of the main metal fitting 11.

In the third step, in the state where an end surface of the center electrode-side chip 14B is brought into contact with the inclined surface 14C of the pedestal 14A formed in the second step, welding is performed using a laser. At this time, the end surface of the center electrode-side chip 14B and the inclined surface 14C of the pedestal 14A are brought into contact with each other so that the center point of the end surface matches the center point of the inclined surface 14C. This enables an increase in the degree of uniformity of the width of the area outside the molten portion between the center electrode-side chip 14B and the pedestal 14A.

In the fourth step, the center electrode 14 is housed in the insulator 12 in such a manner that the pedestal 14A is exposed. At this time, the center electrode 14 is disposed so that the minor axis of the pedestal 14A is directed toward the earth electrode-side chip 13B, and the height of the main metal fitting 11 along the center axis line AX1 is adjusted so that the center axis line AX2 of the earth electrode-side chip 13B and the center axis line AX3 of the center electrode-side chip 14B are positioned on the same axis line.

The above-described embodiment can be modified and implemented as below. Note that the same elements as those in the above-described embodiment are assigned the same reference signs, and thus descriptions thereof are omitted.

In the above-described embodiment, the inclined surface 14C inclined along the minor axis with respect to the center axis line AX1 of the main metal fitting 11 is formed on the end surface of the pedestal 14A, making the inclined surface 14C of the pedestal 14A approximate a perfect circle. Regarding this feature, the inclined surface 14C of the pedestal 14A may be formed in the shape of a perfect circle. In this case, when the pedestal 14A and the center electrode-side chip 14B are laser-welded, the width of the area outside the molten portion between the pedestal 14A and the center electrode-side chip 14B can be made uniform.

In the above-described embodiment, the pedestal 14A is formed so as to have the angle θ of inclination between 20° and 50°, inclusive, but the angle θ of inclination of the pedestal 14A may be set to less than 20° or may be set to greater than 50°.

In the above-described embodiment, the pedestal 14A is formed so as to satisfy the relationship represented by the expression (1). The expression (1) may be replaced by one of the following expressions (2), (3), (4), and (5). The pedestal 14A that satisfies the relationship represented by any of these expressions can satisfy the relationship represented by the expression (1).

$$0.9\times\cos\theta \le b/a \le 1.1\times\cos\theta \quad (2)$$

$$\cos\theta/1.1 \le b/a \le \cos\theta/0.9 \quad (3)$$

$$\cos\theta/1.1 \le b/a \le 1.1\times\cos\theta \quad (4)$$

$$0.9 \le b/(a\times\cos\theta) \le 1.1 \quad (5)$$

In the above-described embodiment, the pedestal 14A is formed so as to satisfy the relationship represented by the expression (1). Regarding this feature, the relationship represented by the expression (1) does not necessarily need to be satisfied. Specifically, as long as the pedestal 14A is formed so as to have an elliptic cylindrical shape, the center electrode 14 is disposed so that the minor axis of the pedestal 14A is directed toward the earth electrode-side chip 13B, and the inclined surface 14C inclined along the minor axis with respect to the center axis line AX1 of the main metal fitting 11 is formed on the end surface of the pedestal 14A, the angle θ of inclination of the pedestal 14A and the relationship between the major diameter a and the minor diameter b of the pedestal 14A are not limited to those satisfying the relationship in the expression (1).

In the above-described embodiment, the inclined portion 13A of the earth electrode 13 is formed so that a part including the other end opposite to one end fixed to the main metal fitting 11 is inclined toward the center axis line AX1 of the main metal fitting 11. Regarding this feature, the inclined portion 13A of the earth electrode 13 may be formed so that a part of the other end area that does not include the other end is inclined toward the center axis line AX1 of the main metal fitting 11. At this time, the shape of the other end of the earth electrode 13 is not limited and may, for example, be formed so as to be parallel to the center axis line AX1 of the main metal fitting 11 and, alternatively, be formed so as to be perpendicularly with respect to the center axis line AX1 of the main metal fitting 11.

In the above-described embodiment, the center axis line AX2 of the earth electrode-side chip 13B and the center axis line AX3 of the center electrode-side chip 14B are positioned on the same axis line. Regarding this feature, as long as the earth electrode-side chip 13B and the center electrode-side chip 14B face each other, the center axis line AX2 of the earth electrode-side chip 13B and the center axis line AX3 of the center electrode-side chip 14B are not required to be positioned on the same axis line.

In the manufacturing process of the ignition plug 1 according to the above-described embodiment, a resistance welding step may be added before performing the third step after completion of the second step. Specifically, in the state where the end surface of the center electrode-side chip 14B is brought into contact with the inclined surface 14C of the pedestal 14A formed in the second step, resistance welding is performed by passing an electric current having a predetermined value through the area between the pedestal 14A and the center electrode-side chip 14B. Thus, the portion where the inclined surface 14C of the pedestal 14A and the center electrode-side chip 14B are brought into contact with each other generates heat due to contact resistance when the electric current flows, resulting in the center electrode-side chip 14B being joined to the inclined surface 14C. By performing the third step in this state, the center electrode-side chip 14B can be kept from being displaced from the pedestal 14A at the time of laser welding.

Figure 9:
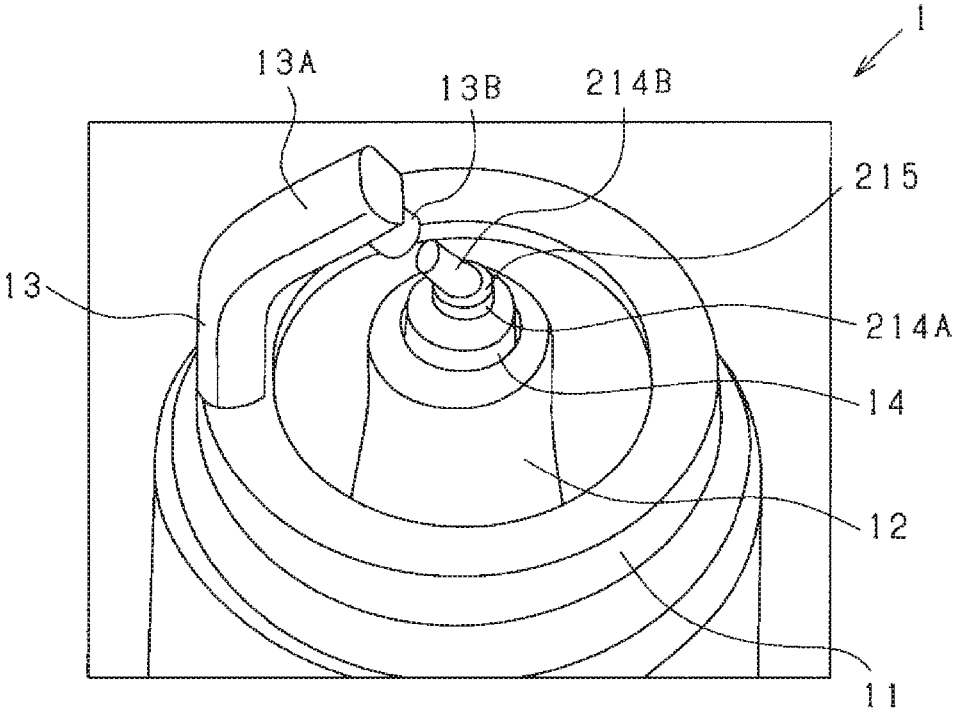
FIG. 9 is a perspective view showing a modification of the ignition plug.
Figure 10:
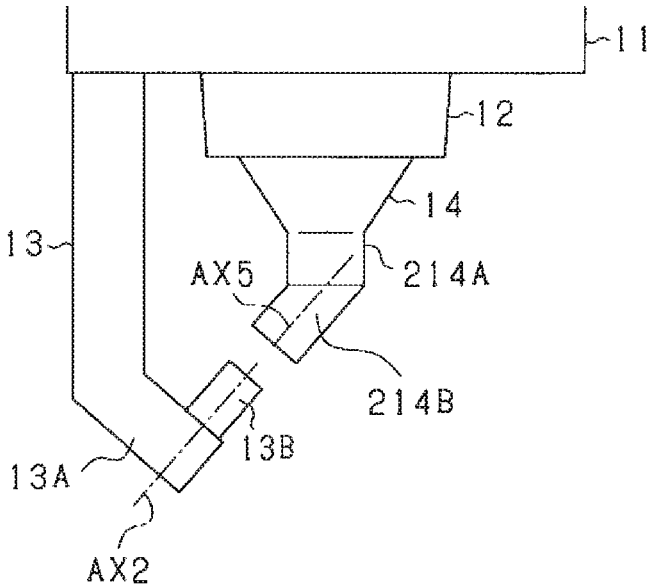
FIG. 10 is an enlarged view of a main area in the modification in FIG. 9.
Figure 11:
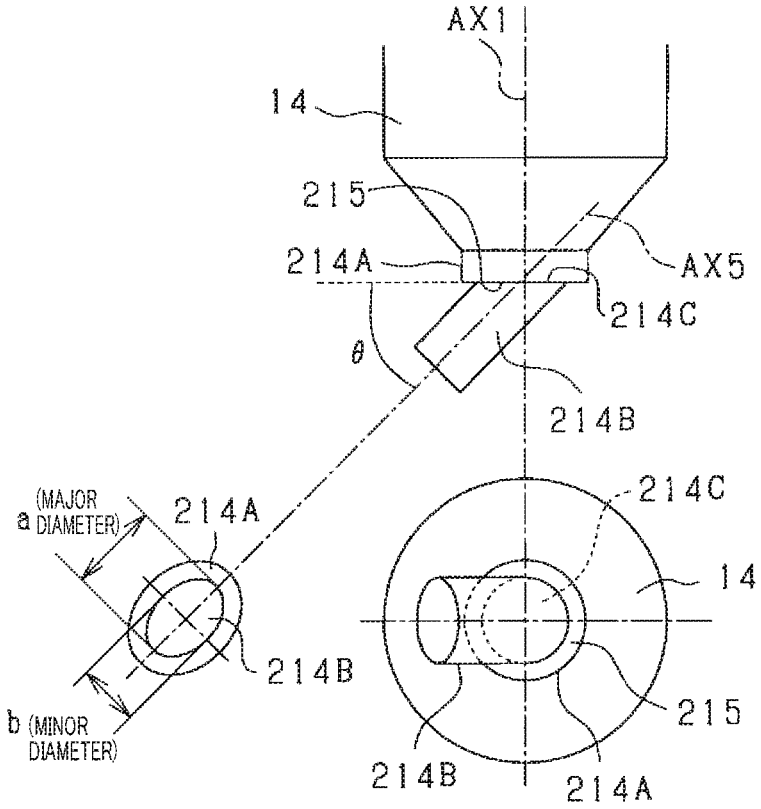
FIG. 11 is a diagram showing, from multiple points of view, a joined state of a circular cylindrical pedestal and an inclined surface of a center electrode-side chip according to the modification in FIG. 9.
Figure 12:
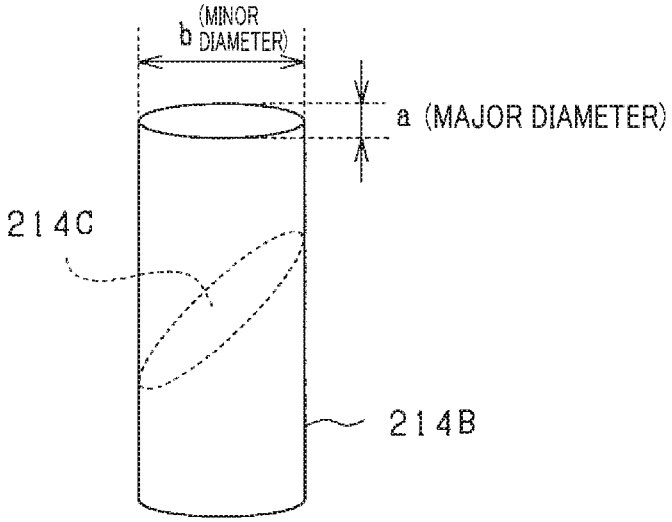
FIG. 12 is a perspective view showing a method for manufacturing a center electrode-side chip.

In the above-described embodiment, the pedestal 14A has an end surface forming the inclined surface 14C inclined along the minor axis with respect to the center axis line AX1. Regarding this feature, as shown in FIGS. 9-11, a center electrode-side chip 214B can be formed which has an elliptic cylindrical shape and is disposed so as to have a minor axis directed toward the earth electrode-side chip 13B, with an end surface forming an inclined surface 214C inclined along the minor axis with respect to an axis line AX5 of the center electrode-side chip 214B itself. In this case, a pedestal 214A has a circular cylindrical shape and is formed on the end portion of the center electrode 14 that is exposed from the main metal fitting 11. Moreover, the inclined surface 214C of the circular cylindrical center electrode-side chip 214B is laser-welded to a surface 215 of the pedestal 214A. Note that an elliptic cylindrical member is formed by inserting a circular cylindrical chip material into an elliptic hole of a drawing mold and performing hot-drawing. Subsequently, as shown in FIG. 12, the elliptic cylindrical member is diagonally cut using a wire saw or the like; in this way, the elliptic cylindrical center electrode-side chip 214B having the inclined surface 214C can be formed.

With the above-described configuration, the inclined surface 214C of the center electrode-side chip 214B approximates a perfect circle, and thus when the pedestal 214A and the center electrode-side chip 214B are laser-welded, the molten state of the center electrode-side chip 214B and the center electrode 14 can be made uniform. Furthermore, since the center electrode-side chip 214B has the inclined surface 214C, the pedestal 214A is not required to have an inclined surface. Therefore, the laser welding can be performed along the surface 215 of the pedestal 214A (that is, the inclined surface 214C) that is perpendicular to the center axis line AX1, as is conventionally done, and thus the laser welding can be performed with ease. Furthermore, the angle θ between the surface 215 of the pedestal 214A and the axis line AX5 of the center electrode-side chip 214B is set between 20° and 50°, inclusive, as in the above-described embodiment, and thus advantageous functions and effects similar to those provided in the above-described embodiment can be provided.

In the above-described configuration, the center electrode-side chip 214B has an end surface forming an inclined surface 214C inclined along the minor axis with respect to the center axis line AX5 of the center electrode-side chip 214B itself, causing the inclined surface 214C to approximate a perfect circle. Regarding this feature, the shape of the inclined surface 214C of the center electrode-side chip 214B may be formed in the shape of a perfect circle (circle). In this case, when the pedestal 214A and the center electrode-side chip 214B are laser-welded, the width of the area of the pedestal 214A outside the molten portion between the pedestal 214A and the center electrode-side chip 214B can be made uniform.

Figure 13:
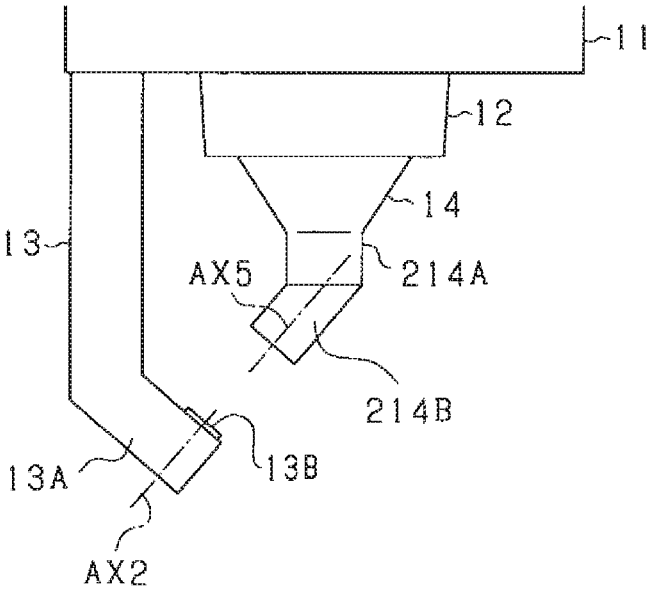
FIG. 13 is an enlarged view of a main area showing another modification of the ignition plug.

The shape of the earth electrode-side chip 13B is not limited to the circular cylindrical shape and may be a rectangular cylindrical shape. As shown in FIG. 13, the shape of the earth electrode-side chip 13B may be a disc shape, an angular shape (the shape of a plate), or the like. Furthermore, the diameter of the earth electrode-side chip 13B may be set to any value, for example, equal to the diameter of the center electrode-side chip 14B, equal to the major diameter a of the center electrode-side chip 214B, equal to the minor diameter b of the center electrode-side chip 214B, or more or less than these diameters.

The pedestal 14A may have an end surface forming the inclined surface 14C inclined along the minor axis with respect to the center axis line AX1, and the center electrode-side chip 214B may have an elliptic cylindrical shape and be disposed so as to have a minor axis directed toward the earth electrode-side chip 13B, with an end surface forming the inclined surface 214C inclined along the minor axis with respect to the center axis line AX5 of the center electrode-side chip 214B itself. Also with this configuration, when the pedestal 14A and the center electrode-side chip 214B are laser-welded, the molten state between the center electrode-side chip 214B and the center electrode 14 can be made uniform. Furthermore, even if the pedestal 14A and the center electrode-side chip 214B is not changed from the circular cylindrical shape to the elliptic cylindrical shape to a significant extent, the angle θ of the axis line AX5 of the center electrode-side chip 214B with respect to the plane perpendicular to the center axis line AX1 can be increased.

The present disclosure has been described in accordance with the embodiment, but the present disclosure should be construed as not being limited to the embodiment, the configuration thereof, and the like. The present disclosure encompasses various variations and modifications made within the range of equivalents thereof. In addition, various combinations and forms, and furthermore, other combinations and forms further including only one element or more or less elements are also included in the scope and spirit of the present disclosure.

Hereinafter, aspects of the above-described embodiment will be summarized.

The first disclosure is an ignition plug (1) mounted in an internal combustion engine (10) including: a main metal fitting (11) having a tubular shape; an earth electrode (13) having one end fixed to the main metal fitting and including, in a part of the other end, an inclined portion (13A) inclined toward a center axis line of the main metal fitting; an earth electrode-side chip (13B) joined to the inclined portion of the earth electrode; a center electrode (14) housed in the main metal fitting and having one end exposed and extending from the main metal fitting; a pedestal (14A) having an elliptic cylindrical shape and disposed so as to have a minor axis directed toward the earth electrode-side chip, the pedestal being formed on an end portion of the center electrode exposed from the main metal fitting and having an end surface (14C) forming an inclined surface inclined along the minor axis with respect to the center axis line; and a center electrode-side chip (14B) having a circular cylindrical shape and laser-welded to the inclined surface of the pedestal. The earth electrode-side chip and the center electrode-side chip have end surfaces facing each other.

The earth electrode of the ignition plug has one end fixed to the main metal fitting and includes, in a part of the other end, an inclined portion inclined toward the center axis line of the main metal fitting. The earth electrode-side chip is joined to the inclined portion. Meanwhile, the end surface of the pedestal formed at the end of the center electrode that is exposed from the main metal fitting includes an inclined surface inclined with respect to the center axis line of the main metal fitting, and the center electrode-side chip is laser-welded to the inclined surface. The earth electrode-side chip and the center electrode-side chip have end surfaces facing each other. In other words, the center axis line of the earth electrode-side chip and the center axis line of the center electrode-side chip are inclined with respect to the center axis line of the main metal fitting.

In the above-described ignition plug, if the pedestal to which the center electrode-side chip is laser-welded is a circular cylindrical, the inclined surface of the pedestal is expected to be elliptical. If the circular cylindrical center electrode-side chip is laser-welded to the elliptical inclined surface of the pedestal, the molten state of the molten portion between the center electrode-side chip and the pedestal is different between the major diameter end and the minor diameter end of the elliptical inclined surface. Specifically, the molten portion at the major diameter side of the elliptical inclined surface contains a larger amount of metal included in the pedestal than that in the molten portion at the minor diameter side of the elliptical inclined surface. Thus, the molten portion may have different coefficients of thermal expansion at the major diameter side and the minor diameter side of the elliptical inclined surface. In other words, the magnitude of thermal stress generated as a result of a change in temperature of the molten portion which joins the center electrode-side chip and the inclined surface of the pedestal together is different between the molten portion at the major diameter side of the elliptical surface and the molten portion at the minor diameter side of the elliptical surface. For this reason, if an internal combustion engine is equipped with the above-described ignition plug in which the center electrode-side chip is attached to the inclined surface formed in the end surface of the pedestal formed on the end portion of the center electrode that is exposed from the main metal fitting, non-uniform thermal stress is generated at the molten portion which joins the center electrode-side chip and the inclined surface of the pedestal together, every time a flammable air-fuel mixture is ignited in the internal combustion engine. Therefore, the joint strength of a part of the molten portion in which particularly high thermal stress is generated is reduced every time the flammable air-fuel mixture is ignited in the internal combustion engine, which may result in separation of the center electrode-side chip from the inclined surface of the pedestal.

As a measure against this issue, the pedestal included in the ignition plug has an elliptic cylindrical shape, is disposed so as to have a minor axis directed toward the earth electrode-side chip, and has, on an end surface on the side on which the center electrode-side chip is laser-welded, an inclined surface inclined along the minor axis with respect to the center axis line. As a result, the inclined surface of the pedestal approximates a perfect circle, and thus when the pedestal and the center electrode-side chip are laser-welded, the molten state of the center electrode-side chip and the center electrode can be made uniform. Accordingly, in the case where an internal combustion engine is equipped with the ignition plug, it is possible to produce a uniform thermal stress in the molten portion which joins the center electrode-side chip and the inclined surface of the pedestal together as a result of the flammable air-fuel mixture ignited in the internal combustion engine, and thus separation of the center electrode-side chip from the pedestal can be prevented.

The second disclosure is an ignition plug (1) mounted in an internal combustion engine (10) including: a main metal fitting (11) having a tubular shape; an earth electrode (13) having one end fixed to the main metal fitting and including, in a part of the other end, an inclined portion (13A) inclined toward a center axis line of the main metal fitting; an earth electrode-side chip (13B) joined to the inclined portion of the earth electrode; a center electrode (14) housed in the main metal fitting and having one end exposed and extending from the main metal fitting; a pedestal (214A) having a circular cylindrical shape and formed on an end portion of the center electrode exposed from the main metal fitting; and a center electrode-side chip (214B) having an elliptic cylindrical shape and disposed to have a minor axis directed toward the earth electrode-side chip, the center electrode-side chip having an end surface forming an inclined surface (214C) inclined along the minor axis with respect to an axis line of the center electrode-side chip, the inclined surface being laser-welded to the pedestal. The earth electrode-side chip and the center electrode-side chip have end surfaces facing each other.

With the above-described configuration, the pedestal has a circular cylindrical shape and is formed on the end portion of the center electrode that is exposed from the main metal fitting. The center electrode-side chip has an elliptic cylindrical shape, is disposed so as to have a minor axis directed toward the earth electrode-side chip, and has an end surface forming an inclined surface inclined along the minor axis with respect to the center axis line of the center electrode-side chip, and the inclined surface is laser-welded to the pedestal. As a result, the inclined surface of the center electrode-side chip approximates a perfect circle, and thus when the pedestal and the center electrode-side chip are laser-welded, the molten state of the center electrode-side chip and the center electrode can be made uniform.

According to the first disclosure described above, laser welding needs to be performed along the inclined surface of the pedestal that is inclined with respect to the center axis line of the main metal fitting. In contrast, with the above-described configuration, the center electrode-side chip has the inclined surface, and thus the pedestal is not required to have the inclined surface. Therefore, the laser welding can be performed along the surface of the pedestal that is perpendicular to the center axis line, as is conventionally done, and thus the laser welding can be performed with ease.

What is claimed is:

1. An ignition plug mounted in an internal combustion engine, the ignition plug comprising:

a main metal fitting having a tubular shape;

an earth electrode having one end fixed to the main metal fitting and including, in a part of the other end, an inclined portion inclined toward a center axis line of the main metal fitting;

an earth electrode-side chip joined to the inclined portion of the earth electrode;

a center electrode housed in the main metal fitting and having one end exposed and extending from the main metal fitting;

a pedestal having an elliptic cylindrical shape and disposed so as to have a minor axis directed toward the earth electrode-side chip, the pedestal being formed on an end portion of the center electrode exposed from the main metal fitting and having an end surface forming an inclined surface inclined along the minor axis with respect to the center axis line; and a center electrode-side chip having a circular cylindrical shape and laser-welded to the inclined surface of the pedestal, wherein the earth electrode-side chip and the center electrode-side chip have end surfaces facing each other.

2. The ignition plug according to claim 1, wherein the pedestal having the elliptic cylindrical shape satisfies $$0.9\times\cos\theta\leq b/a\leq\cos\theta/0.9$$

where a is a length of a major diameter, b is a length of a minor diameter, and θ is an angle of inclination of the inclined surface with respect to a plane perpendicular to a center axis line of the pedestal.

3. The ignition plug according to claim 1, wherein the pedestal having the elliptic cylindrical shape satisfies $$20^\circ\leq\theta\leq50^\circ$$

where θ is an angle of inclination of the inclined surface with respect to a plane perpendicular to a center axis line of the pedestal.

4. The ignition plug according to claim 1, wherein the inclined surface is circular in shape.

5. The ignition plug according to claim 1, wherein an area of the inclined surface outside a molten portion in which the center electrode-side chip is laser-welded has a uniform width.

6. A method for manufacturing an ignition plug according to claim 1, the method comprising:

a first step of forming the pedestal having the elliptic cylindrical shape at one end of the center electrode by cold forging;

a second step of forming the inclined surface inclined along the minor axis with respect to the center axis line by cutting one end of the pedestal formed in the first step;

a third step of performing laser welding in a state where an end surface of the center electrode-side chip is brought into contact with the inclined surface formed in the second step; and a fourth step of housing the center electrode in the main metal fitting in a manner to expose the pedestal.

7. The method according to claim 6, further comprising:

a resistance welding step of performing resistance welding on the pedestal and the center electrode-side chip in a state where the end surface of the center electrode-side chip is brought into contact with the inclined surface formed in the second step, the resistance welding step being performed before performing the third step after completion of the second step.

8. An ignition plug mounted in an internal combustion engine, the ignition plug comprising:

a main metal fitting having a tubular shape;

an earth electrode having one end fixed to the main metal fitting and including, in a part of the other end, an inclined portion inclined toward a center axis line of the main metal fitting;

an earth electrode-side chip joined to the inclined portion of the earth electrode;

a center electrode housed in the main metal fitting and having one end exposed and extending from the main metal fitting;

a pedestal having a circular cylindrical shape and formed on an end portion of the center electrode exposed from the main metal fitting; and a center electrode-side chip having an elliptic cylindrical shape and disposed to have a minor axis directed toward the earth electrode-side chip, the center electrode-side chip having an end surface forming an inclined surface inclined along the minor axis with respect to an axis line of the center electrode-side chip, the inclined surface being laser-welded to the pedestal, wherein the earth electrode-side chip and the center electrode-side chip have end surfaces facing each other.

9. The ignition plug according to claim 8, wherein the inclined surface is circular in shape.

10. The ignition plug according to claim 8, wherein an area of the pedestal outside a molten portion in which the center electrode-side chip is laser-welded has a uniform width.

11. The ignition plug according to claim 8, wherein the inclined surface is perpendicular to the center axis line.

* * * * *